US011776434B2

(12) United States Patent
Dawson et al.

(10) Patent No.: US 11,776,434 B2
(45) Date of Patent: Oct. 3, 2023

(54) METHOD AND APPARATUS FOR AVOIDANCE OF DAMAGE TO CONCEALED MECHANICAL SYSTEMS SUCH AS PLUMBING AND THE LIKE

(71) Applicant: DRM Specialties, LLC, Houston, TX (US)

(72) Inventors: Randall L. Dawson, Conroe, TX (US); Edward Joseph Mueller, Tomball, TX (US); James C. Robertson, Houston, TX (US)

(73) Assignee: DRM Specialties, LLC, Houston, TX (US)

( * ) Notice: Subject to any disclaimer, the term of this patent is extended or adjusted under 35 U.S.C. 154(b) by 0 days.

(21) Appl. No.: 16/176,260

(22) Filed: Oct. 31, 2018

(65) Prior Publication Data

US 2019/0287429 A1 Sep. 19, 2019

Related U.S. Application Data

(63) Continuation-in-part of application No. 15/869,996, filed on Mar. 19, 2018, now abandoned.

(51) Int. Cl.

| | |
|---|---|
| ***G09F 3/20*** | (2006.01) |
| ***G09F 3/00*** | (2006.01) |
| ***G09F 1/06*** | (2006.01) |
| *G09F 3/02* | (2006.01) |
| *G09F 1/10* | (2006.01) |

(52) U.S. Cl.

CPC ..... *G09F 3/205* (2013.01); *G09F 1/065* (2013.01); *G09F 3/0295* (2013.01); *G09F 1/10* (2013.01); *G09F 2003/0251* (2013.01); *G09F 2003/0276* (2013.01)

(58) Field of Classification Search

CPC ..... G09F 3/0295; G09F 3/205

USPC ..... 52/105; 174/507; 40/310, 316, 332, 335, 40/599, 665

See application file for complete search history.

(56) References Cited

U.S. PATENT DOCUMENTS 1,216,269 A * 2/1917 Bates ..... G09F 3/14 40/665

1,272,394 A * 7/1918 Devney ..... G05G 1/02 40/331

(Continued)

*Primary Examiner* — Robert Canfield

(74) *Attorney, Agent, or Firm* — MADAN LAW PLLC; Jeffrey Streets

(57) ABSTRACT

A method and apparatus for avoidance of damage to concealed mechanical elements during construction or repair of a structure. In one embodiment, a tag is provided for installation on a plumbing or similar element prior to such element being concealed by further construction. The tag is adapted to engage a concealed element in such a way that an indicator portion of the tab remains visible after further concealing structure is installed. The visible tab's location identifies the location of concealed elements and is preferably provided with indicia identifying such purpose. In a further embodiment of the invention, adhesive indicator tape is used in conjunction with an indicator tab. The indicator tape is adapted to be applied over concealing structure to generally identify the location and extent of concealed elements that may be susceptible to puncture or damage during subsequent construction or repair phases of a project.

19 Claims, 12 Drawing Sheets

(56) References Cited

U.S. PATENT DOCUMENTS 2,669,047 A * 2/1954 Rieger ..... G09F 3/14 40/637
2,761,231 A * 9/1956 Hess ..... A47F 13/00 40/657
3,149,431 A * 9/1964 Blish ..... G09F 3/04 40/311
3,491,470 A * 1/1970 Geisinger ..... G09F 3/18 40/661
3,530,543 A * 9/1970 Claude ..... G09F 3/14 24/16 R
3,785,337 A * 1/1974 Flowerday ..... E01F 13/028 116/209
3,831,300 A * 8/1974 Berkhouse ..... G09F 23/00 40/310
D234,473 S * 3/1975 Ringle ..... D20/22
4,087,946 A * 5/1978 Harris ..... E03C 1/02 52/105
4,197,984 A * 4/1980 Hartman ..... B65D 75/54 206/806
4,216,598 A * 8/1980 Newbert ..... G09F 3/04 40/331
4,246,712 A * 1/1981 Vander Wall ..... G09F 3/14 40/316
4,623,282 A * 11/1986 Allen ..... F16L 1/11 116/DIG. 14
4,680,882 A * 7/1987 Watson, Jr. ..... G09F 11/23 292/307 R
4,742,796 A * 5/1988 Halsey ..... A01K 3/005 116/200
4,862,617 A * 9/1989 Cooke, Jr. ..... G09F 3/18 40/663
4,916,871 A * 4/1990 Anderson ..... E04B 2/82 52/105
4,988,236 A * 1/1991 Ramsey ..... F16L 1/11 116/209
D319,474 S * 8/1991 Steiner ..... D20/22
D329,468 S * 9/1992 Hatt ..... D20/42
5,402,592 A * 4/1995 Caveney ..... G09F 3/205 40/665
D390,275 S * 2/1998 Wolff ..... D20/22
5,778,583 A * 7/1998 Larsen ..... G09F 3/14 40/637
5,920,053 A * 7/1999 DeBrouse ..... B64F 1/366 235/375
5,943,804 A * 8/1999 Linguist ..... G09F 3/04 40/637
6,183,016 B1 * 2/2001 Parker ..... G09F 3/04 283/70
D438,908 S * 3/2001 Najmi ..... D20/28
6,212,809 B1 * 4/2001 Gaule ..... G09F 3/0295 40/660
6,371,692 B1 * 4/2002 Fatigati ..... F16L 1/11 116/209
6,527,246 B1 * 3/2003 Stinnett ..... F16L 1/06 248/530
6,588,134 B1 * 7/2003 Perelli ..... G09F 7/22 40/331
6,642,445 B1 * 11/2003 Lalancette ..... H02G 1/00 174/135
6,857,801 B2 * 2/2005 Van Bever ..... B41J 3/4075 40/316
7,406,791 B2 * 8/2008 Lienau ..... G09F 7/00 116/200
7,437,830 B1 * 10/2008 Kulavic ..... B25H 7/04 33/562
7,958,648 B1 * 6/2011 MacConnell ..... B25H 7/045 33/613
8,555,467 B2 * 10/2013 Kelly ..... B65D 63/1081 24/16 PB
9,711,068 B2 * 7/2017 St. Denis ..... G09F 19/22
2004/0194360 A1 * 10/2004 McCabe ..... G09F 3/14 40/316
2005/0138854 A1 * 6/2005 Simmons ..... G09F 3/14 40/665
2005/0257410 A1 * 11/2005 Horowitz ..... G09F 3/14 40/665
2006/0143963 A1 * 7/2006 Nowakowski ..... G09F 3/04 40/673
2007/0053741 A1 * 3/2007 Myers ..... F16L 1/11 404/9
2008/0098637 A1 * 5/2008 Pratt ..... G09F 3/04 40/673
2008/0209749 A1 * 9/2008 Chua ..... E04G 21/1891 33/758
2009/0308303 A1 * 12/2009 Burlando ..... F16L 1/11 116/209
2010/0187256 A1 * 7/2010 Draisma ..... B65D 23/065 222/108
2010/0313454 A1 * 12/2010 Smith, Jr. ..... G09F 3/0295 40/316
2012/0192471 A1 * 8/2012 Watson ..... B29C 45/14836 40/665
2012/0198738 A1 * 8/2012 Olivarez ..... G09F 3/0295 40/316
2012/0216469 A1 * 8/2012 Mescall ..... E03C 1/021 52/220.1
2014/0041316 A1 * 2/2014 Norwood ..... E06B 1/62 52/58
2014/0109484 A1 * 4/2014 Szyjkowski ..... E04F 19/083 49/465

* cited by examiner

METHOD AND APPARATUS FOR AVOIDANCE OF DAMAGE TO CONCEALED MECHANICAL SYSTEMS SUCH AS PLUMBING AND THE LIKE

RELATED APPLICATIONS

This application is a continuation-in-part of prior pending U.S. patent application Ser. No. 15/869,996 filed on Mar. 19, 2018, which application is hereby incorporated by reference herein in its entirety.

BACKGROUND

The present invention relates generally to the fields of residential and commercial construction, and more particularly relates to methods and apparatuses for avoiding inadvertent and undesirable puncture and damage to plumbing and/or other mechanical structures during the course of construction or repairs.

In the commercial and residential construction trades, there is customarily a progression of project phases ranging from excavation and creation of a foundation, to erection of a structure, to installation of mechanical systems including utilities such as plumbing and electrical systems, and various finishing phases. Construction, including remodeling and repairs, also occurs on pre-existing structures.

During a construction (or remodeling/repair) project, there is often an overlap in the involvement of various specialty trades, including framers, plumbers, electricians, drywallers, roofers, floor installers, and so on, as would be appreciated by those of ordinary skill in the art.

In a common scenario, some portion of the overall plumbing and electrical systems, including water supplies and sewer pipes, wiring and/or wiring conduits, and other mechanical systems may be established within the excavation, over which a foundation, such as a concrete slab, is formed. Once a foundation is laid, framers will erect the frame or "skeleton" of a structure, after which interior and exterior walls are applied. The construction of a frame may consist of interior and exterior walls comprising, for example 2×4" or 2×6" sills, headers, and studs. Exterior walls are typically clad with exterior sheathing of some type (e.g., particle board or plywood), which in turn may be overlaid with a final exterior material, ranging from brick, stucco, stone, wood paneling, masonry, or other suitable exterior materials. Interior walls often consist of drywall applied to the studs.

Prior to completion of interior and exterior walls, plumbing and electrical trades are enlisted to run the necessary piping and wiring for the structure, much of which typically is contained in and extends within the walls (and floors), as would be appreciated by persons of ordinary skill in the art. Plumbing, of course, consists of pipes which are very often made of PVC or other material that is susceptible to puncture such as by nails. Likewise, wiring may be exposed within wall cavities or may be contained within puncture-susceptible conduit.

The inventors have observed an all-to-frequently recurring problem with respect to the typical construction process as it pertains to the phases after plumbing and electrical trades have installed plumbing and wiring systems within the walls of a structure. As described above, both interior and exterior walls are typically finished only after plumbing and electrical systems are installed within the walls of a structure. Not uncommonly, plumbing and conduit that projects upwardly from the foundation of a structure is extended further through the walls to reach interior locations. As noted above, such plumbing and similar structures, in current practice, often consists of PVC pipes or other materials which are susceptible to damage, such as by nail punctures, during subsequent construction steps. For example, three-inch PVC pipes may be provided for sewage lines, and smaller-diameter PVC pipes are used for water supply lines. Other damage/puncture-susceptible types of piping may be used, including, without limitation, copper, PEX (polyethylene crosslink), and CPVC, as would be known to those of ordinary skill in the art. It is to be understood that as used herein, the terms "plumbing," "piping," and the like shall be interpreted broadly to include not merely water supply, but also water and sewage, draining, Freon® and other gas supply lines, vents, and so on, all of which may be susceptible to damage, including damage comprising puncture by nails, screws, and other fasteners.

A situation frequently arises in which an exterior cladding, such as of particle board or plywood, is applied to form an exterior wall, thereby concealing from view the presence of plumbing and other mechanical structures and systems that are present and extend within the walls. Similarly, drywall is typically applied to interior walls, also concealing the presence and location of plumbing and other mechanical structures and systems within the walls.

As further exterior treatment is applied, for example, siding, stone, stucco, or masonry surfaces, it is often necessary to fasten materials to the base cladding of the exterior surface. Prior to a final treatment, often a vapor barrier such as Tyvek™ wrap is attached to the skin of the structure. Commonly, nails often driven by pneumatic nail guns are employed for the purposes of finalizing the exterior of a structure.

At any point after materials have been installed which conceal the presence and location of plumbing, electrical and other mechanical structures contained within walls, any further installations or treatments involving the affixation of material to the walls, particularly with nails, screws, and the like, creates the potential for inadvertent puncture of the concealed plumbing, wiring, and the like. The inventors have observed that such punctures occur with significant regularity on construction, repair, and remodeling sites, and that the potential structural damage that can be caused if such punctures go undetected can be enormously costly and difficult to repair. Notably, it is entirely possible for such puncture damage to in fact be undetected for some time, making later diagnosis of such damage even more difficult. It has been the inventors' experience that such accidental damage occurs quite frequently, and at enormous financial cost to owners, contractors and/or insurers.

In view of the foregoing and other considerations, the present invention is directed to methods and apparatuses for avoidance of inadvertent damage (including by not limited to punctures) during construction and repair of commercial and residential structures.

In accordance with one aspect of the invention, a locating tag is provided for providing a visual indication of the presence, location, and/or orientation of plumbing and other damage/puncture-susceptible mechanical elements after materials have been installed that would otherwise conceal such elements. In accordance with another aspect of the invention, an adhesive tape may be provided to be used in conjunction with the locating tags to further delineate the presence and location of concealed plumbing and other puncture-susceptible mechanical elements.

In one embodiment, a locating tag is adapted to be installed around the base of an upwardly-projecting mechanical element such as a plumbing riser extending out of the foundation of a structure under construction. The locating tag is configured such that it extends away from the element on which it is installed, in at least one direction, and such that it remains visible even after structures and materials are applied which conceal the location of the element.

Locating tags in accordance with the present invention may be made of various materials, and may be rigid, semi-rigid, or flexible. By way of example but not limitation, a locating tag in accordance with the invention may be made of rigid or semi-rigid plastic, and may be shaped so as to conform to a customary arrangement of plumbing risers, which typically extend upwardly out of a building's foundation. Alternatively, locating tags in accordance with the present invention may be made of more flexible materials, such as cardboard, paper, plastic, Mylar®, fabric, nylon, nonwoven polyethylene fiber (e.g., Tyvek®), and the like.

In one embodiment, a locating tag is provided with perforations and/or cuts which enable the tag to be installed around plumbing. For example, a locating tag may be provided with radial cuts or perforations defining a circular aperture through which a pipe or conduit may extend. The extent of the perforations or cuts may be sufficient to permit installation of the locating tag over pipes having a range of diameters.

In other embodiments described herein, various configurations of locating tags are provided for securing the locating tags onto or proximate to mechanical elements whose locations are to be identified.

In another complementary embodiment and aspect of the invention, adhesive tape is utilized in conjunction with locating tags to further delineate the presence and location of plumbing and other puncture-susceptible elements as they may be concealed by overlying materials and structure. In one embodiment, adhesive tape bearing appropriate indicia of its intended purpose is provided for application following installation of any material and structure that tends to conceal a puncture-susceptible element.

BRIEF DESCRIPTION OF THE DRAWINGS

The foregoing and other features and advantages of the present invention will be more fully appreciated by reference to a detailed description of one or more preferred embodiments of the invention, when read in conjunction with the accompanying drawings, in which.

DETAILED DESCRIPTION

In the disclosure that follows, in the interest of clarity, not all features of actual implementations are described. It will of course be appreciated that in the development of any such actual implementation, as in any such project, numerous engineering and technical decisions must be made to achieve the developers' specific goals and subgoals (e.g., compliance with system and technical constraints), which will vary from one implementation to another. Moreover, attention will necessarily be paid to proper engineering practices for the environment in question. It will be appreciated that such development efforts might be complex and time-consuming, outside the knowledge base of typical laymen, but would nevertheless be a routine undertaking for those of ordinary skill in the relevant fields.

Figure 1:
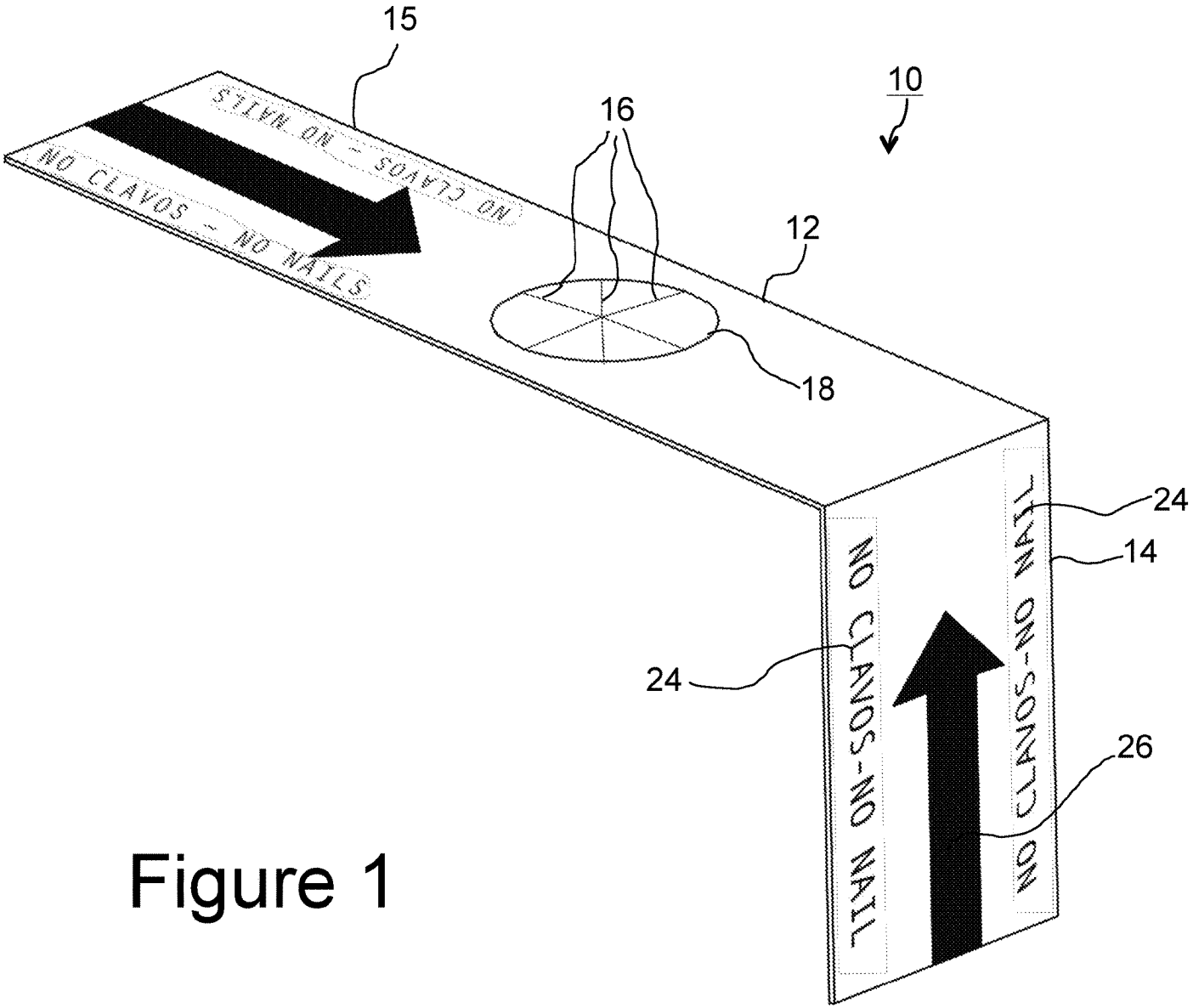
FIG. 1 is a perspective view of a locating tag in accordance with one embodiment of the invention.

Referring to FIG. 1, there is shown a locating tag 10 in accordance with one embodiment of the invention. As shown in FIG. 1, locating tag 10 has a substantially flat upper engagement portion 12, a first flap portion 14, and a second flap portion 15. As shall hereinafter be described and apparent, first flap portion is adapted to remain visible on an exterior side of an eventual exterior wall structure, while second flap portion 15 is adapted to remain visible on an interior side of an eventual interior wall structure, thereby providing locating information regarding the presence of plumbing or other mechanical structures that are eventually otherwise concealed.

In the embodiment of the invention shown in FIG. 1, locating tag 10 is made of a semi-rigid plastic material, with an angled relationship between engagement portion 12 and flap portion 14, and with flap portion 15 being essentially contiguous with engagement portion 12.

It is to be expressly noted that alternative embodiments of locating tags are contemplated herein. The various embodiments may be made from any number of different materials having different properties including varying degrees of thickness and rigidity. Various materials believed to be potentially suitable for the purposes of the present disclosure include thermoplastics, especially thermoplastic sheet materials. Amorphous plastic sheet materials, such as polystyrene (HIPS) sheets, polycarbonate (PC) sheets, ABS sheets, polyvinyl chloride (PVC) sheets, expanded PVC sheets, PET sheets, which are advantageously capable of having appropriate indicia printed thereon. Polyolefin sheet materials, such as polyethylene materials (PE, LDPE, MDPE, HDPE, UHMWPE) or polypropylene (PP, homopolymer PP, copolymer PP) may have desirable cost and flexibility qualities. Thermoplastic elastomer (TPE) sheet material likewise may have desirable flexibility properties. Other materials potentially suitable for the locating tags in accordance with this disclosure include, without limitation, cardboard, paper, Mylar®, fabric, nylon, nonwoven polyethylene fiber, and the like.

As will be appreciated by those of ordinary skill in the art, certain materials may not lend themselves to having a pre-formed and persistent angular relationship defined between the engagement portion 12 and flap portion 14 of a particular embodiment. It is believed that those of ordinary skill having the benefit of the present disclosure will readily appreciate how different materials may operate to achieve the objectives of the invention as described herein.

Returning to FIG. 1, engagement portion 12 of locating tag 10 is preferably provided with a plurality of slits or perforated lines 16 which define an engagement aperture 18 in engagement portion 12. As would be appreciate by those of ordinary skill in the art, slits 16 and aperture 18 enable engagement portion 12 to be installed over or around a pipe or similar mechanical structures, as herein described.

Figure 1A:
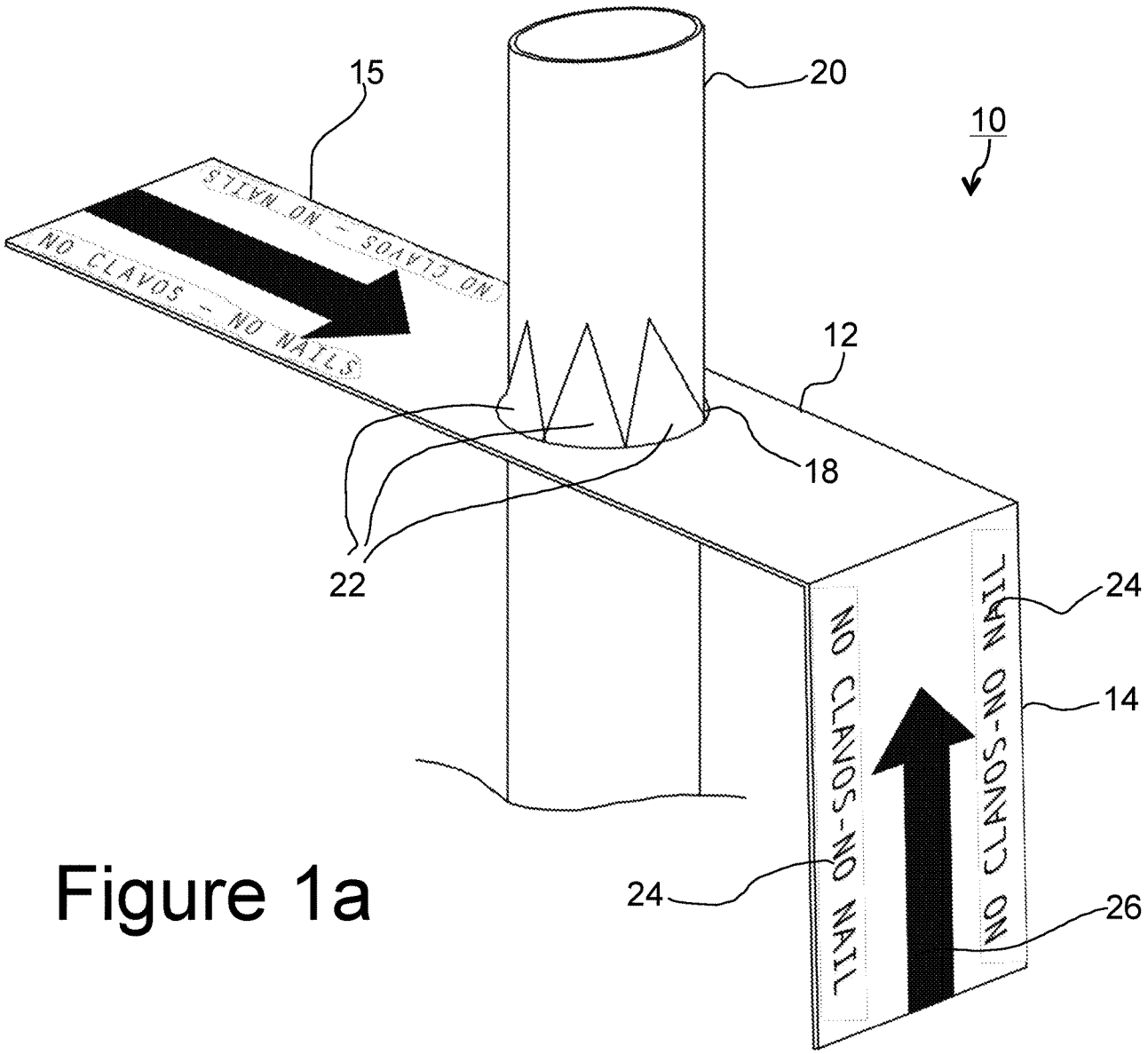
FIG. 1*a* is a perspective view of the locating tag from FIG. 1 as it is engaged around a plumbing riser in accordance with one embodiment of the invention.

In particular, turning to FIG. 1*a*, there is shown the locating tag 10 of FIG. 1 having been installed or engaged around a pipe (plumbing riser) 20. As shown in FIG. 1*a*, slits 16 from FIG. 1 create flaps 22 which deflect upon insertion of a structure such as a pipe through aperture 18. Regardless of the material from which locating tag 10 is made, it is contemplated that tag 10 be sufficiently flexible to permit deflection of flaps 22 to accommodate pipes of any size equal to or smaller than the diameter of aperture 18. Thus, as would be apparent to those of ordinary skill, a given locating tag may accommodate and be applied over and around pipes or other structures of varying diameters or dimensions.

As shown in FIGS. 1 and 1*a*, a locating tag 10 in accordance with the present invention is preferably provided with informational indicia on first and second flap portions 14 and 15, such as words and arrow markings, which inform an observer the reason and nature of its placement. In the embodiment of FIGS. 1 and 1*a*, the indicia "NO CLAVOS—NO NAIL" (reference numeral 24) appear along with an arrow (reference numeral 26) to indicate and emphasize both the purpose and the location of locating tag 10. As will hereinafter be made apparent in further detail, the presence of such indicia 24 and 26 on flap portion 14 serves to be informative during later phases of construction where engagement portion 12 may be partially or fully concealed. Although the exemplary embodiment shows the indicia as consisting of the words "NO CLAVOS—NO NAIL," it is to be understood that other explanatory verbiage, in one or multiple languages, may be utilized as preferred in any given implementation. The verbiage of the indicia 24 may refer not only to nails, but to screws, or to the concept of puncture in general.

In a preferred embodiment, locator tag 10 preferably has a vivid color, such as red or orange (by way of example but not limitation), such that its intended function as a visual indicator of the presence of otherwise concealed mechanical systems is emphasized.

Figure 2A:
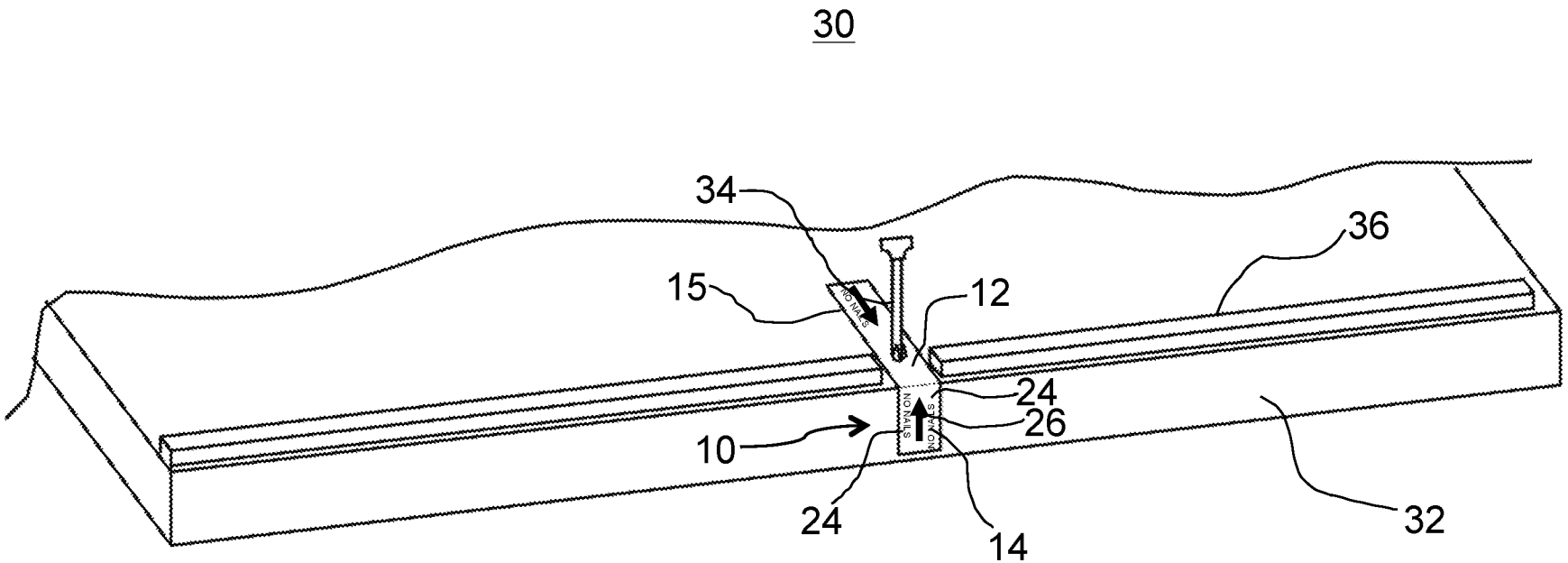
FIG. 2*a* is a perspective view of a structure under construction showing placement of a locating tag in accordance with one embodiment of the invention to indicate the presence of plumbing within a sill portion.

Turning to FIG. 2*a*, there is shown a partial perspective view of a structure under construction designated generally with reference numeral 30 in which the locating tag 10 of the present invention (or any embodiment thereof) is advantageously utilized. In the illustration of FIG. 2*a*, there is shown a structural foundation or slab 32, such as might commonly be formed out of concrete, and having at least one plumbing element (riser) extending upwardly therethrough, as would be familiar to those of ordinary skill in the art. In accordance with conventional construction practices, riser 34 is located generally near the periphery of foundation slab 32, and may be accommodated by a gap in a sill element 36, such as a 2×4" or 2×6" board.

As is apparent from FIG. 2*a*, engagement portion 12 of locating tag 10 is engaged with and around riser 34 and positioned such that tab portion 14 of tag 10 extends beyond the edge of foundation/slab 32 and tab portion 15 extends inwardly beyond any interior wall material that may be applied.

Figure 2B:
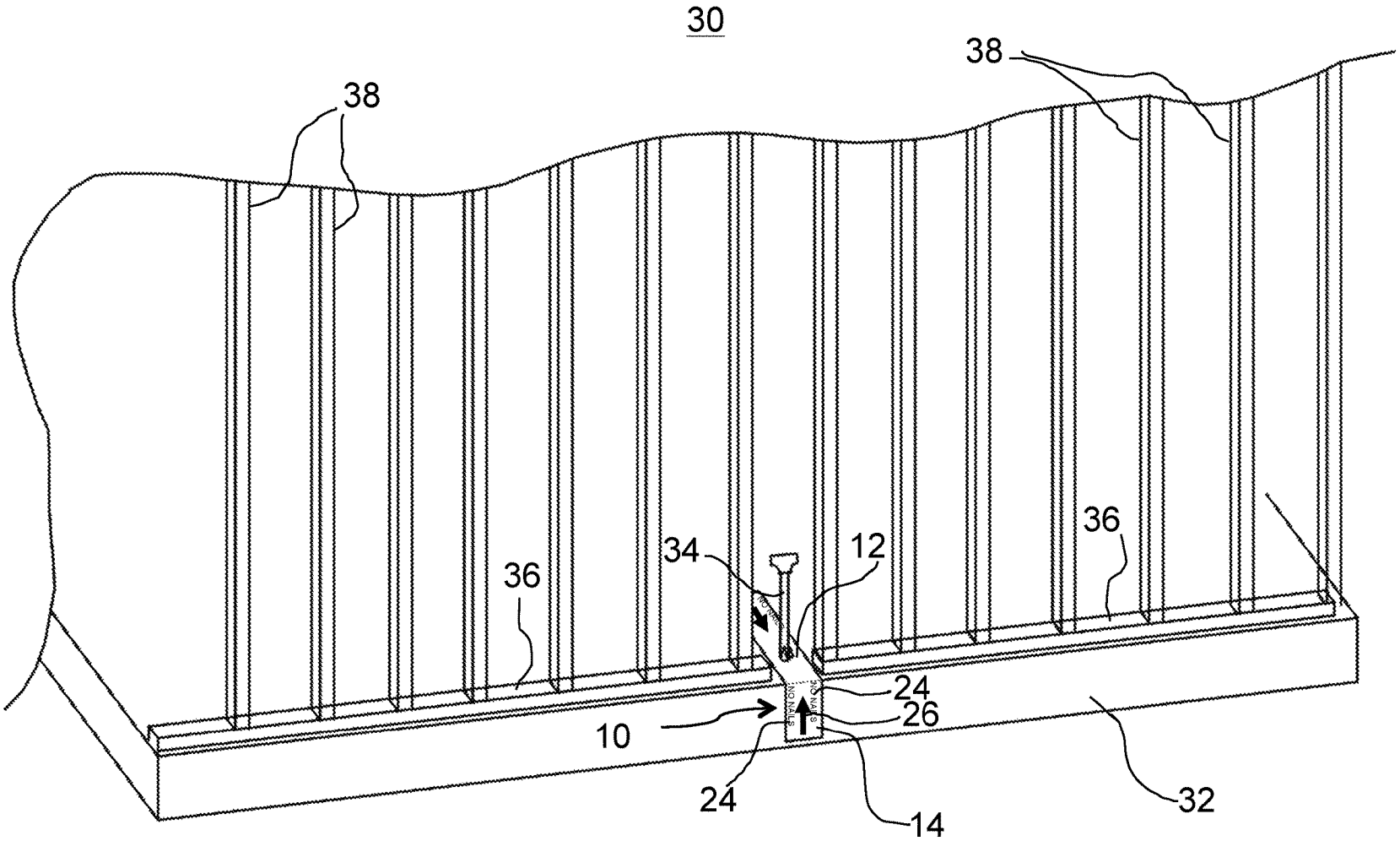
FIG. 2*b* is a perspective view of the structure under construction of FIG. 2*a* after erection of wall studs in the structure.

In FIG. 2*b*, a subsequent phase of construction of the structure 30 from FIG. 2*a* is shown, in which vertical studs (exemplary ones of which being identified with reference numerals 38) have been erected.

Figure 2C:
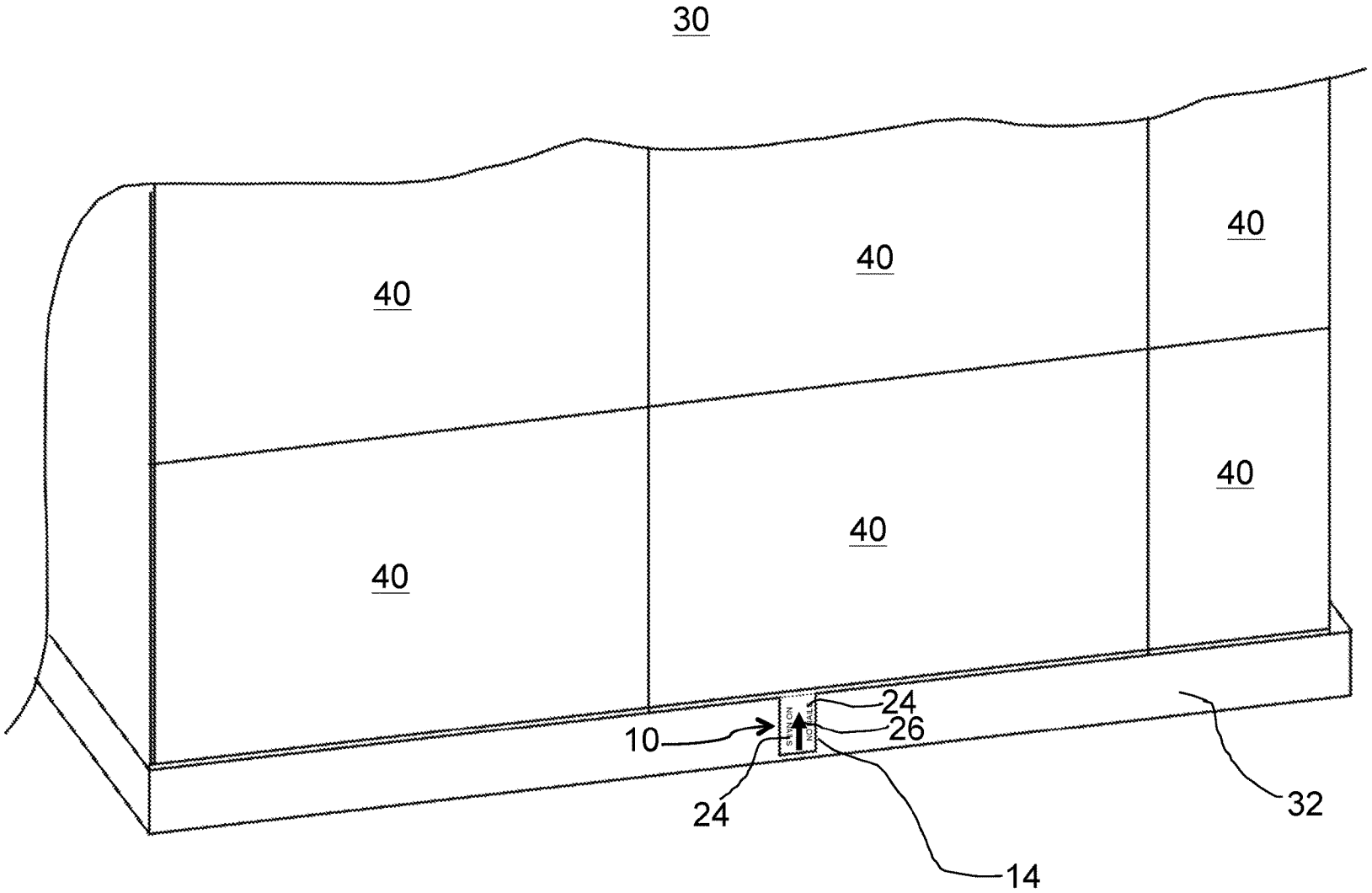
FIG. 2*c* is a perspective view of the structure under construction of FIG. 2*c* after application of exterior wall material over the wall studs.

In FIG. 2*c*, another subsequent phase of construction of the structure 30 is shown, in which material making up outer wall surfaces 40, such as plywood, particle board, or the like, have been attached to the exterior of structure 30, such as by nailing to studs 38 (FIG. 2*b*) as would be familiar to those of ordinary skill in the art. It is to be particularly noted from the illustration of FIG. 2*c* that certain elements of the structure 30 previously observable in FIG. 2*b* are obscured from view in the phase of FIG. 2*c*. In particular, riser 34 is no longer visible, nor are studs 38, sill 36, or even engagement portion 12 of locating tag 10. Notably, however, and In accordance with a particular aspect of the invention, tab portion 14 of locating tag 10 remains visible following application of exterior cladding material 40. Moreover, the indicia 24 and 26 on tab portion 14 serve to inform an observer the location of otherwise obscured riser 34. Similarly, although not explicitly shown in FIG. 2*c*, second tab portion 15 remains visible on the opposing side of studs 38 even after application of interior wall material, such as drywall.

Figure 2D:
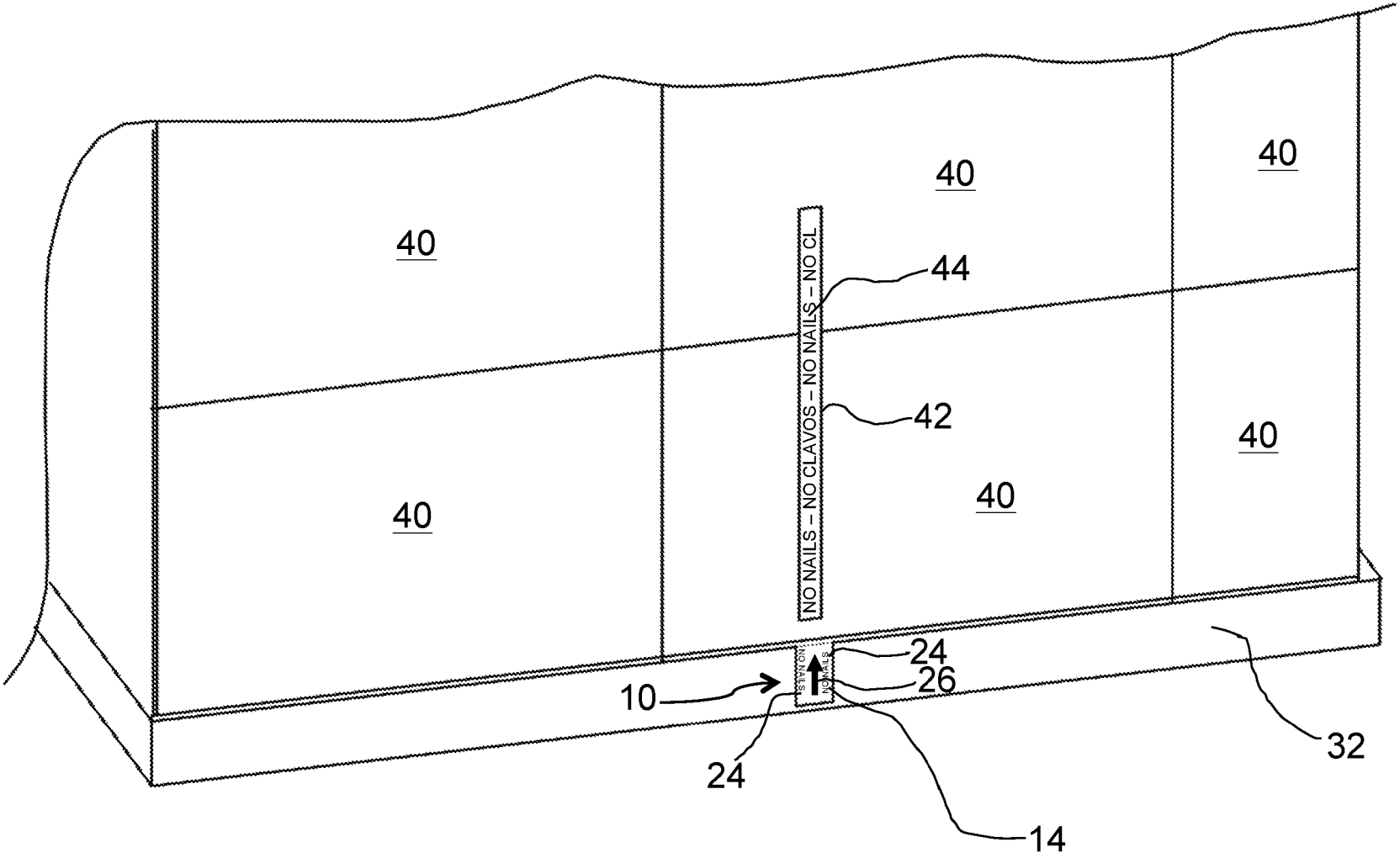
FIG. 2*d* is a perspective view of the structure under construction of FIG. 2*d* after application of locating tape over the exterior wall material.

Turning now to FIG. 2*d*, there is illustrated a further aspect of the invention as it relates to the avoidance of damage to concealed plumbing during construction or repair work being performed on a structure. As shown in FIG. 2*d*, an additional aspect of one preferred embodiment of the invention involves the application of indicator tape 42 atop an outer, concealing element of a structure under construction or repair. In a preferred embodiment, indicator tape 42 is provided with textual indicia 44 of its intended purpose, namely to delineate and identify the presence of plumbing concealed by wall material 40.

In accordance with one embodiment of the invention, adhesive tape of sufficient dimensions and visibility is provided for being applied atop any element that would otherwise conceal plumbing. Those of ordinary skill in the art will appreciate that such tape is preferably applied in conjunction with the application of the element(s) that are concealing plumbing. Preferably, tape is provided which has sufficient adhesive qualities as to be applied reliably to many surfaces, and is preferably marked with indicia 44 reflecting its purpose to deter those involved in subsequent construction stages from inadvertently causing damage to plumbing that is concealed.

Figure 3:
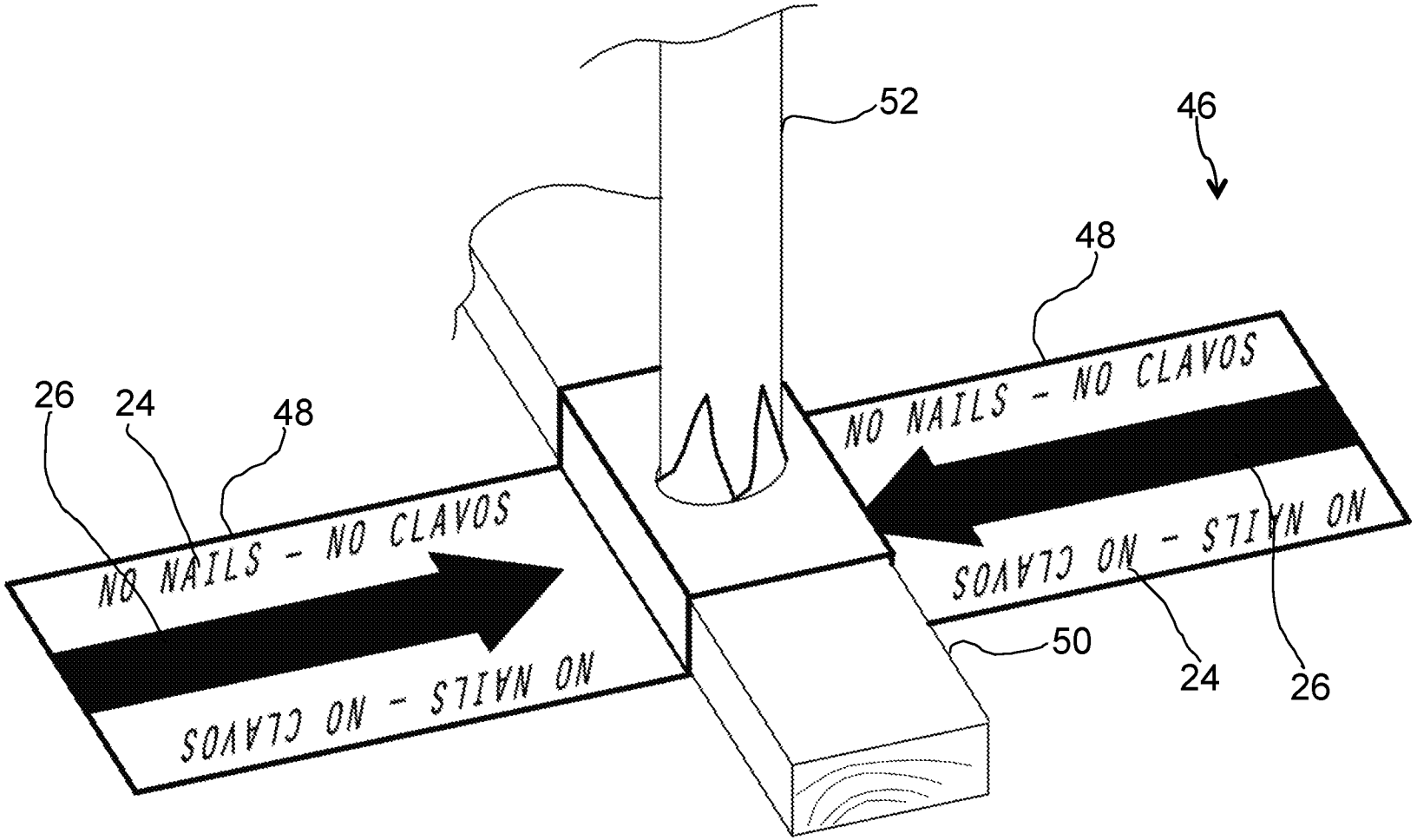
FIG. 3 is a perspective view of a locating tag in accordance with another alternative embodiment of the invention installed over a sill element.

Turning now to FIG. 3, there is shown yet another alternative embodiment of the invention, comprising a locating tag 46 which is adapted for use in applications where it may be desirable to delineate the presence of plumbing on two opposing sides of a wall or other concealing structure. Such construction scenarios can occur, for example, where interior walls of, for example, a bathroom, where a sill (such as a 2×4) delineates the presence of a wall to be erected. In the embodiment of FIG. 3, locating tag 46 is bidirectional and more or less symmetrical, inasmuch as it is has first and second opposing flap portions 48 configured to extend outwardly from both sides of a sill 50 through which a riser 52 or other structure susceptible to inadvertent puncture extends. As would be appreciated by those of ordinary skill, once a wall surface, such as drywall, is installed so as to conceal riser 52, flap portions 48 would remain exposed with the indicia 24 and 26 thereon (as in the embodiment of FIG. 1) calling out the presence and placement of riser 52.

Figure 3A:
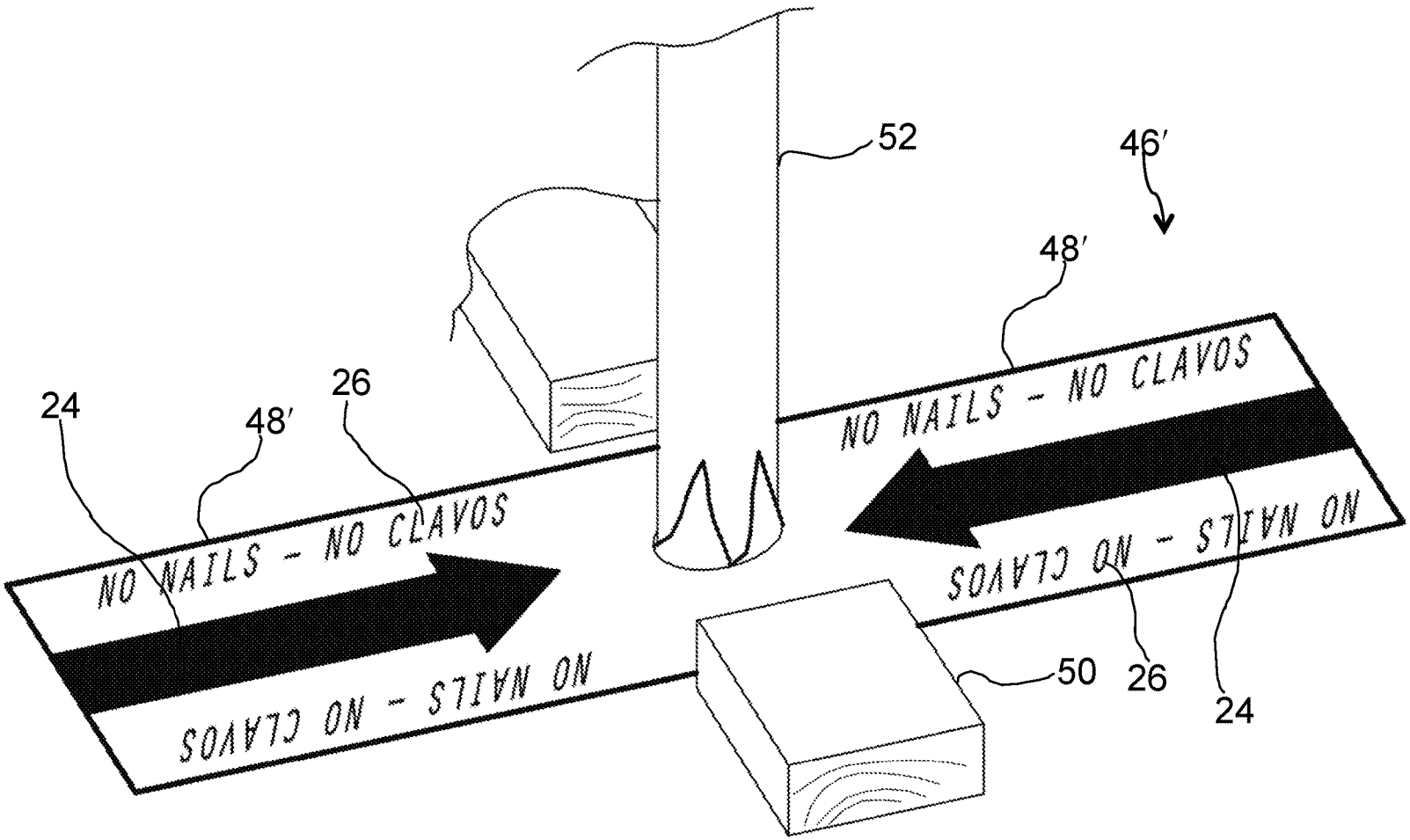
FIG. 3*a* is a perspective view of a locating tag in accordance with another alternative embodiment of the invention installed within a gap in a sill element.

FIG. 3*a* illustrates a further variation of the embodiment of FIG. 3, in which a bidirectional locating tag 46' having first and second opposing flap portions 48' is adapted to engage a riser 52 extending between two separate segments of a sill 50. Flap portions 48' are sufficient in length to extend beyond wall surfaces applied to either side of sill 50. As would be appreciated by those of ordinary skill, once a wall surface, such as drywall, is installed so as to conceal riser 52, flap portions 48' would remain exposed with the indicia 24 and 26 thereon (as in the embodiment of FIG. 1) calling out the presence and placement of riser 52.

Figure 4A:
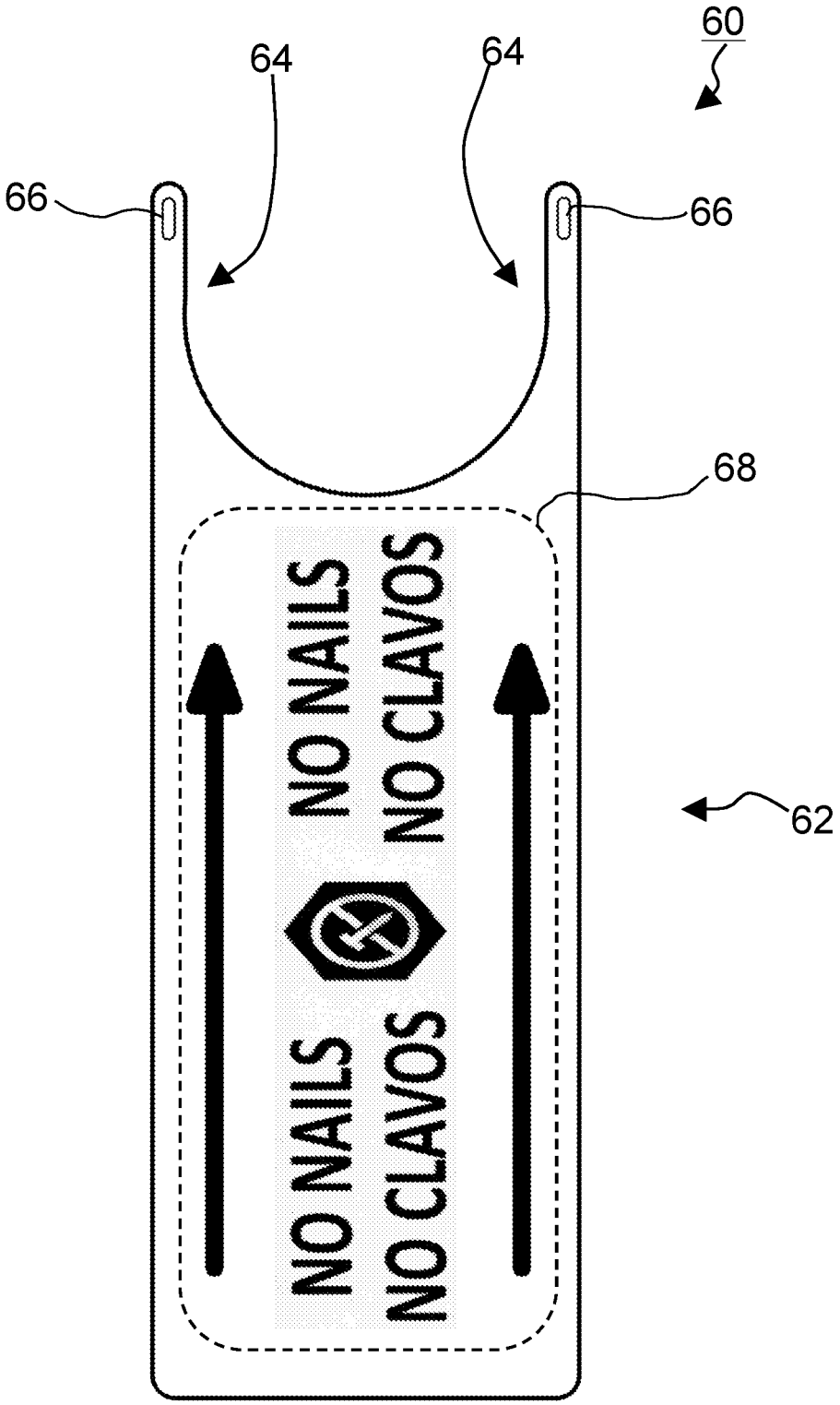
FIG. 4*a* is a front view of a locating tag in accordance with an alternative embodiment of the invention.

Referring now to FIG. 4*a*, there is shown a locating tag 60 in accordance with an alternative embodiment of the invention. As shown in FIG. 4*a*, locating tag 60 comprises a flat sheet of material—including but without limitation any of the aforementioned materials considered suitable for the purposes of the invention. In the embodiment of FIG. 4*a*, tag 60 includes an extended indicator portion designated generally with reference numeral 62 and a pair of extending connector portions 64. Each connector portion 64 is provided with an opening 66 for facilitating installation of tag 60 as hereinafter described.

Preferably, indicator portion 62 of locating tag 60 bears indicia such as designated within dashed line 68 in FIG. 4*a*.

Figure 4B:
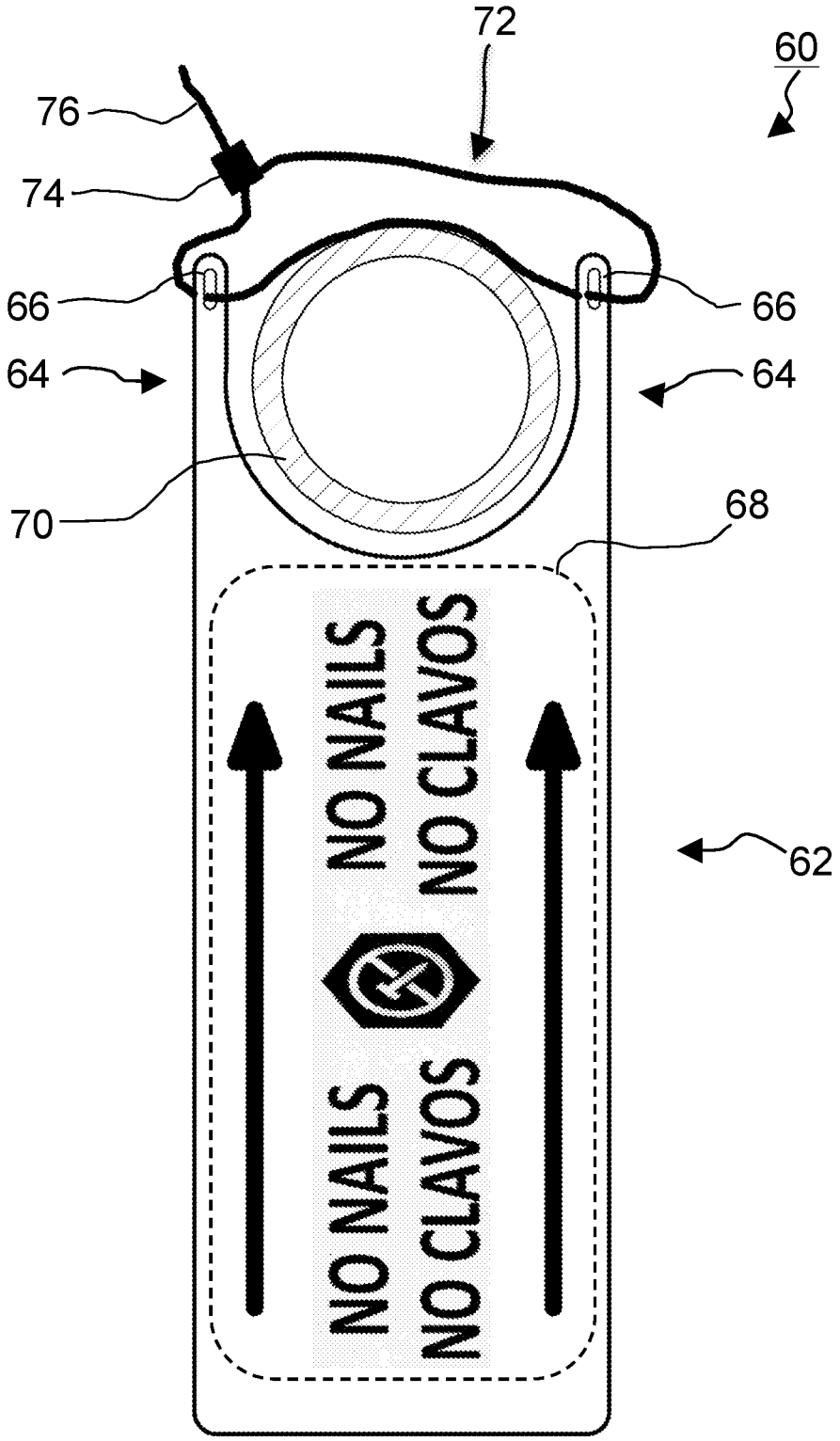
FIG. 4*b* is a front view of the locating tag from FIG. 4*a* installed around a plumbing element.

FIG. 4*b* depicts locating tag 60 from FIG. 4*a* installed around a mechanical structure, in particular, a pipe 70 shown in cross-section in FIG. 4*b*, and secured with a cable tie 72.

As is well-known, a cable tie (also known as a wire tie, hose tie, steggel tie, zap strap or zip tie, and various brand names) is a type of elongate fastener, commonly made of nylon, for binding, securing or otherwise holding items together. Because of their low cost and ease of use, cable ties are ubiquitous, finding use in a wide range of applications. Cable tie 72 in FIG. 4*b* is shown having an engaging element 74 at a proximal end. Engaging element 74 has a slot therein for receiving a distal end 76 therethrough, once the cable tie 72 has been threaded through holes 66.

Figure 5:
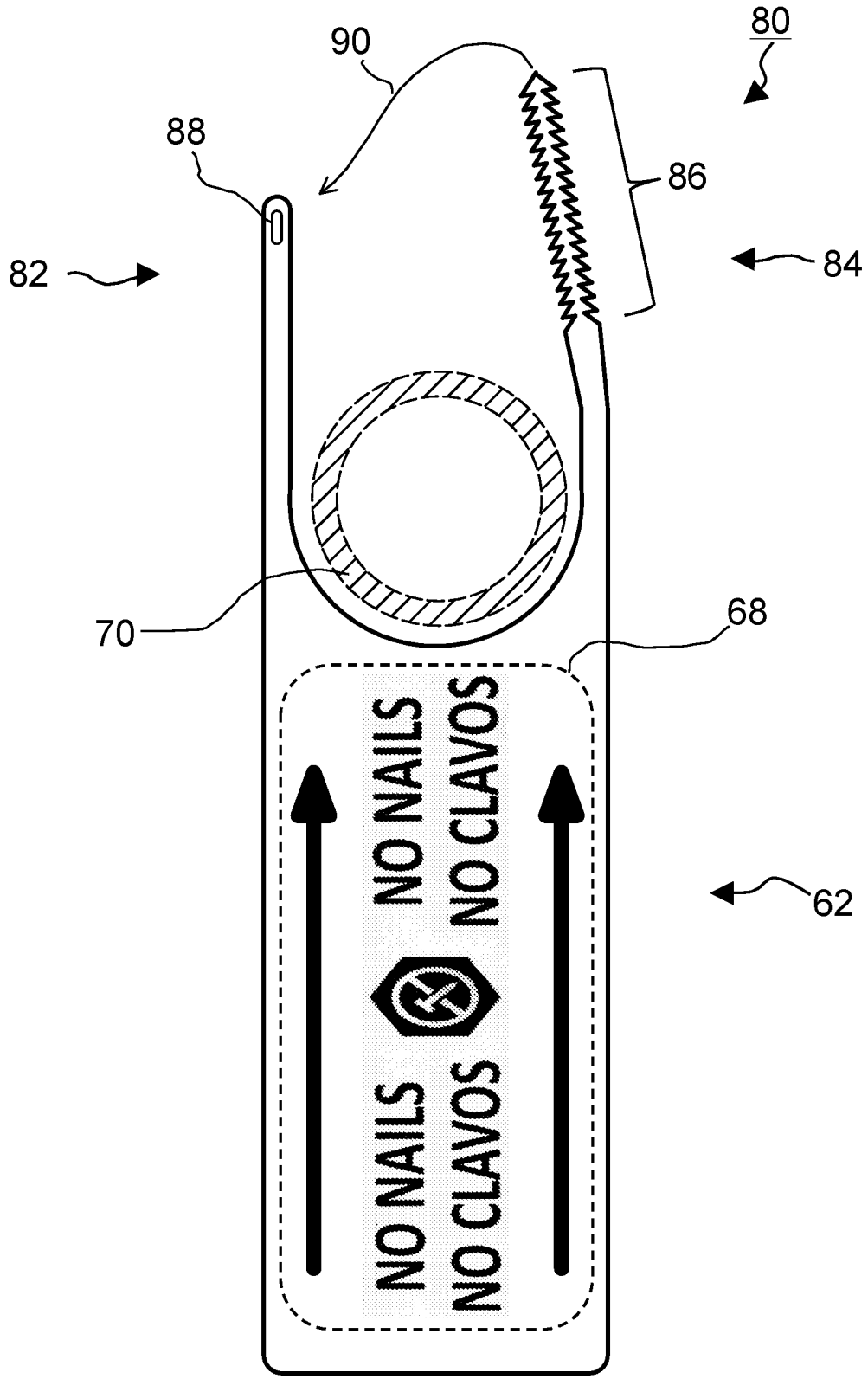
FIG. 5 is a front view of a locating tag in accordance with another alternative embodiment of the invention.

FIG. 5 depicts another alternative embodiment 80 of a locator tag in accordance with the present disclosure. As shown in FIG. 5, locating tag 80 comprises a flat sheet of material—including but without limitation any of the aforementioned materials considered suitable for the purposes of the invention. In the embodiment of FIG. 5, tag 80 includes an extended indicator portion designated generally with reference numeral 62 and a pair of extending connector portions 82 and 84. Connector portions 82 and 84 are configured to engage with one another for facilitating installation of tag 80 as hereinafter described.

Preferably, indicator portion 62 of locating tag 60 bears indicia such as designated within dashed line 68 in FIG. 5.

In the embodiment of FIG. 5, connector portion 84 of locating tag 80 includes a toothed section 86 adapted to be received through an engaging slot 88 in connector portion 82. As depicted in FIG. 5, tag 80 may be installed around a pipe 70 and secured in place by insertion of toothed section 86 into and engaging slot 88, as represented by arrow 90 in FIG. 5. As would be apparent from FIG. 5, the engagement of toothed section 86 in engaging slot 88 tends to maintain the engagement of connector portions 82 and 84. Preferably the relative dimensions of the teeth on toothed section 86 and engaging slot 88 are such that at least some purposeful amount of force must be exerted to disengage connector portions 82 and 84.

Figure 6:
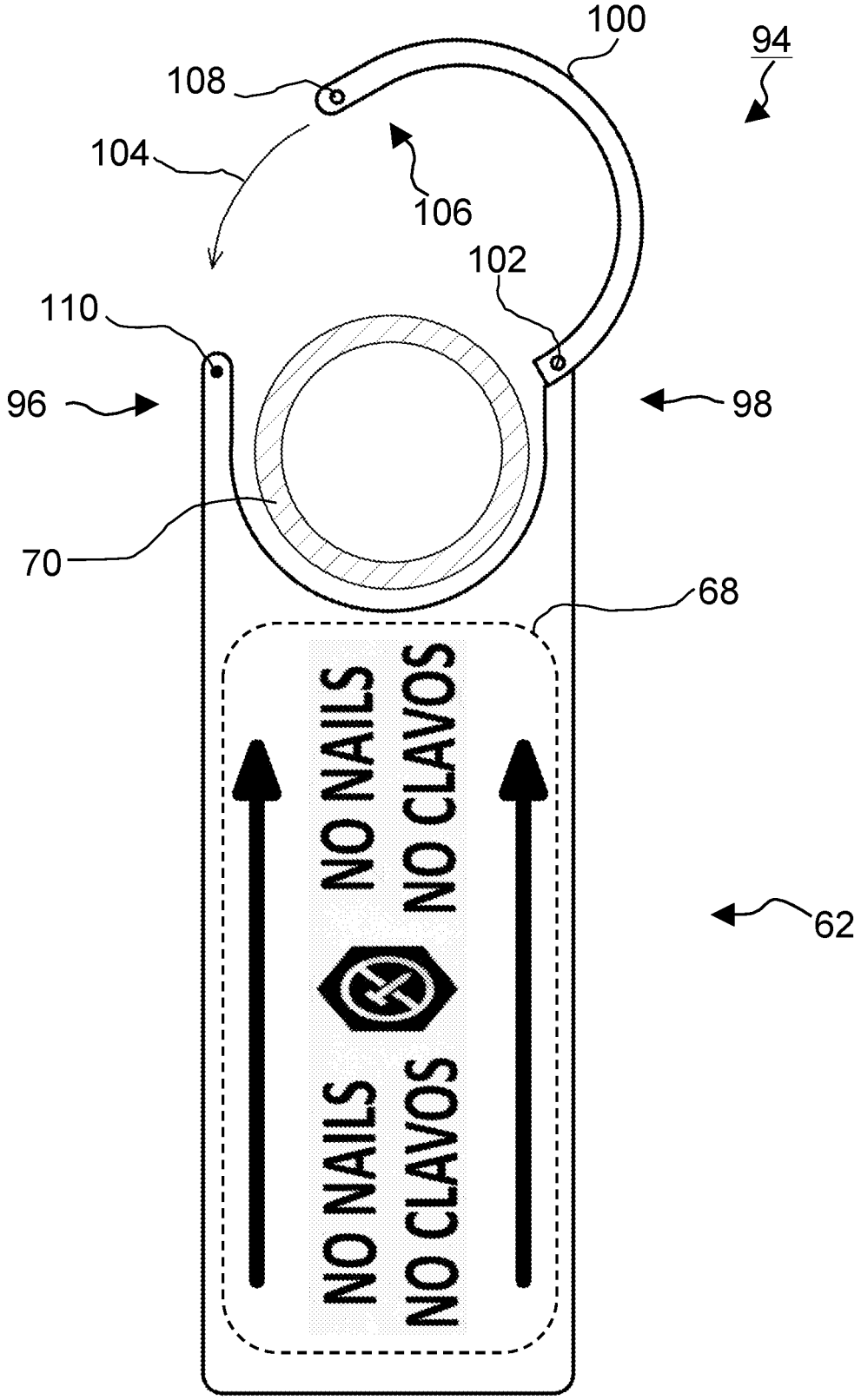
FIG. 6 is a front view of a locating tag in accordance with another alternative embodiment of the invention.

Turning now to FIG. 6, there is shown another alternative embodiment 94 of a locating tag in accordance with the present disclosure. As shown in FIG. 6, locating tag 94 comprises a flat sheet of material—including but without limitation any of the aforementioned materials considered suitable for the purposes of the invention. In the embodiment of FIG. 6, tag 94 includes an extended indicator portion designated generally with reference numeral 62 and a pair of extending connector portions 96 and 98. Preferably, indicator portion 62 of locating tag 60 bears indicia such as designated within dashed line 68 in FIG. 6.

In the embodiment of FIG. 6, locating tag 94 comprises a second engaging element 100 for facilitating engagement of tag 94 around a structure such as pipe 70 shown in FIG. 6. Engaging element 100 is coupled by means of a pivot or hinge structure 102 to connector portion 98. It is contemplated that various structures may be suitable for the purposes of forming the pivoting or hinging connection between connector portion 98 and engaging element 100. Pivot/hinge structure may be either as an integrated living-hinge constructed from a flexible material or a mechanical hinge. The mechanical hinge may be constructed from same material of the tag or incorporate additional hardware, such as fasteners, snaps, screws, rivets and locks to both create movement and secure closure. The living-hinge may also include additional hardware such as fasteners, snaps, screws, rivets and locks to secure closure.

Pivot/hinge structure 102 enables engaging element 100 to be moved from an open position, to a closed position, as indicated by arrow 104 in FIG. 6. Preferably, an end 106 of engaging element 100 opposite pivot/hinge structure 102 is configured to engage with connector portion 96 on the main body of tag 94. For example, end 106 may have a hole 108 for engagement with a corresponding connection element 110 on connector portion 96.

The foregoing embodiments of the invention have been described herein, for illustrative purposes, as they relate to the concealment of mechanical systems within a wall or other structure. As has already been suggested herein, and as would be apparent to those of ordinary skill in the art having the benefit of the present disclosure, the present invention may be advantageously practiced in order to avoid inadvertent damage to elements other than plumbing lines. Those of ordinary skill in the art will recognize that there are numerous elements in many structures that are susceptible to inadvertent puncture or damage once such elements are concealed by subsequent construction steps such as installation and treatment of walls. Such puncture-susceptible elements include, in addition to plumbing lines (pipes), such elements as electrical wiring, whether or not extending through or nominally protected by conduit, as well as heating/cooling/ventilation ducts. The present invention is believed to have applicability to the avoidance of inadvertent damage to any element which might be concealed within the wall of a structure, and the term "puncture-susceptible element" is intended herein to refer to any such potentially damaged item or structure.

Moreover, as has also already been noted, those of ordinary skill in the art will appreciate that inadvertent punctures can occur as the result of use of a variety of different fasteners, including without limitation nails, screws, rivets, toggle bolts, and so on.

At least one embodiment of the invention has been described herein solely for the purposes of illustrating the invention in its various aspects. It is contemplated and to be explicitly understood that various substitutions, alterations, and/or modifications, including but not limited to any such implementation variants and options as may have been specifically noted or suggested herein, may be made to the disclosed embodiments of the invention without necessarily departing from the technical and legal scope of the invention as defined in the claims below.

With regard to the material from which indicator tags may be made, it has already been noted that various materials of differing qualities may be advantageously used. Such materials may have differing characteristics, such as their cost, flexibility, color, thickness, and so on.

What is claimed is:

1. A flexible locating tag for visually indicating the presence and location of a damage-susceptible element within a wall, comprising:

an indicator portion adapted to extend away from the damage-susceptible element and along a foundation to extend beyond wall material to be used during construction of the wall such that the indicator portion remains visible after installation of wall material over the indicator portion and structure adjacent to and concealing the damage-susceptible element; and first and second connector portions extending from the indicator portion and adapted to engage the damage-susceptible element, wherein the first and second connector portions are configured to be affixed to the damage-susceptible element and to position the indicator portion so that at least some of the indicator portion remains exposed after installation of the material over the structure adjacent to the damage-susceptible element, and wherein the indicator portion has a thickness and flexibility so that the indicator portion does not interfere with the installation of the wall material over the structure adjacent to the damage-susceptible element and a length that allows the indicator portion to remain visible after construction of the wall to visually indicate the presence and location of the damage-susceptible element.

2. The flexible locating tag of claim 1, wherein the indicator portion and the first and second connector portions are made with a flexible sheet material.

3. The flexible locating tag of claim 2, wherein the flexible sheet material is sufficiently flexible to bend at a 90-degree angle around the edge of the wall material.

4. The flexible locating tag of claim 3, wherein the flexible sheet material is made with polyethylene.

5. The flexible locating tag of claim 3, wherein the indicator portion has sufficient length to extend in an exterior direction away from the damage-susceptible element and remain visible from an exterior side of a wall beyond an edge of a foundation after installation of an exterior cladding and an exterior brick layer overlaying the cladding with the first and second connector portions affixed to the damage-susceptible element with an elongate fastener.

6. The flexible locating tag of claim 5, wherein the first and second connector portions are spaced apart at a distance greater than three inches to receive a three-inch PVC pipe therebetween.

7. The flexible locating tag of claim 6, wherein the indicator portion has a circular arc extending between the first and second connector portions, wherein the circular arc has a diameter greater than three-inches.

8. The flexible locating tag of claim 7, wherein each of the first and second connector portions have a width that is less than about $1/8^{th}$ of a width of the indicator portion.

9. The flexible locating tag of claim 3, wherein the flexible sheet material is sufficiently thin to extend between the wall material and a foundation without displacing the wall material relative to the foundation.

10. The flexible locating tag of claim 2, wherein the first and second connector portions are configured to be affixed to the damage-susceptible element with an elongate fastener.

11. The flexible locating tag of claim 10, wherein the elongate fastener is a cable tie.

12. The flexible locating tag of claim 2, where the first connector portion includes a first hole and the second connector portion includes a second hole, wherein the tag is configured to be affixed to the damage-susceptible element by positioning the first and second connector portions on opposing sides of the damage-susceptible element and securing an elongate fastener through the first and second holes.

13. The flexible locating tag of claim 12, wherein the elongate fastener is a cable tie.

14. The flexible locating tag of claim 2, wherein the indicator portion includes informational indicia that indicate the location of the damage susceptible element.

15. A method for avoidance of damage to a damage-susceptible element within a wall, comprising affixing a flexible locating tag to the damage-susceptible element during construction of the wall, wherein the flexible locating tag has an indicator portion;

positioning the indicator portion of the flexible locating tag along a foundation to extend beyond material to be used during construction of the wall; and constructing the wall on the foundation with a wall material that is applied over the indicator portion and conceals the damage-susceptible element, wherein the indicator portion has a thickness and flexibility so that the indicator portion does not interfere with construction of the wall and a length that allows the indicator portion to remain visible after construction of the wall to visually indicate the presence and location of the damage-susceptible element.

16. The method of claim 15, wherein the damage-susceptible element comprises a pipe extending within the wall and the indicator portion remains visible even after construction of the wall to indicate the location of the pipe.

17. The method of claim 15, wherein the indicator portion includes informational indicia to inform a person that the damage susceptible element is within the wall at the location of the indicator portion.

18. The method of claim 15, wherein the flexible locating tag is affixed to the damage-susceptible element using a zip tie.

19. The method of claim 15, wherein the wall material being applied is an exterior cladding and/or interior drywall.

* * * * *